United States Patent [19]

Thomas et al.

[11] Patent Number: 4,762,442

[45] Date of Patent: Aug. 9, 1988

[54] SUPPORT DEVICE FOR AN OFF-SHORE OIL DRILLING JACK-UP PLATFORM LEG AND PLATFORM INCLUDING SAID DEVICE

[75] Inventors: Pierre-Armand Thomas, Puteaux; Jean C. Naudin, Paris Cedex; Michel Ningler, Courbevoie, all of France

[73] Assignee: Technip Geoproduction, Paris, France

[21] Appl. No.: 943,066

[22] Filed: Dec. 18, 1986

[30] Foreign Application Priority Data

Dec. 19, 1985 [FR] France ..... 85 18884

[51] Int. Cl.[4] ..... E02B 17/08

[52] U.S. Cl. ..... 405/196; 405/204; 405/224

[58] Field of Search ..... 405/195, 196, 204, 197–200, 405/203, 208, 221, 224, 227

[56] References Cited

U.S. PATENT DOCUMENTS 2,430,014 11/1947 Hansen .
3,412,564 11/1968 McClintock .
4,008,497 2/1977 Badon ..... 405/196 X
4,583,881 4/1986 Steele ..... 405/198

FOREIGN PATENT DOCUMENTS 0042540 12/1981 European Pat. Off. .
2071740 9/1981 United Kingdom .

*Primary Examiner*—David H. Corbin
*Attorney, Agent, or Firm*—Wenderoth, Lind & Ponack

[57] ABSTRACT

A support device for a leg (2) of an off-shore drilling jack-up platform including a separate heightener (3) adapted to be interposed between each leg of the platform and the sea bed so as to increase the depth of installation of the platform. Each heightener is provided with detachable means (4, 7, 11, 12) for connecting the heightener to the lower end (4) of a respective leg (2) which improves the strength thereof.

33 Claims, 12 Drawing Sheets

FIG.5
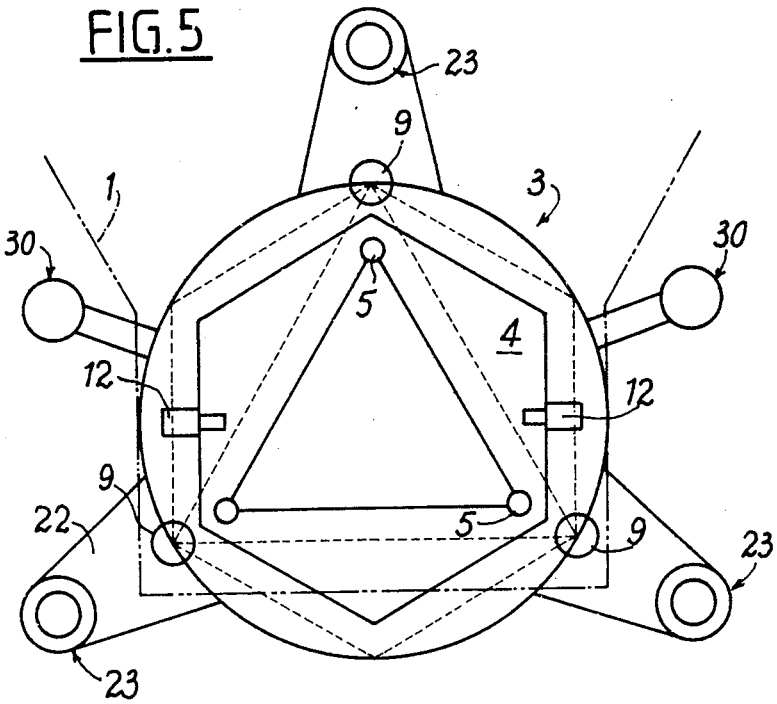
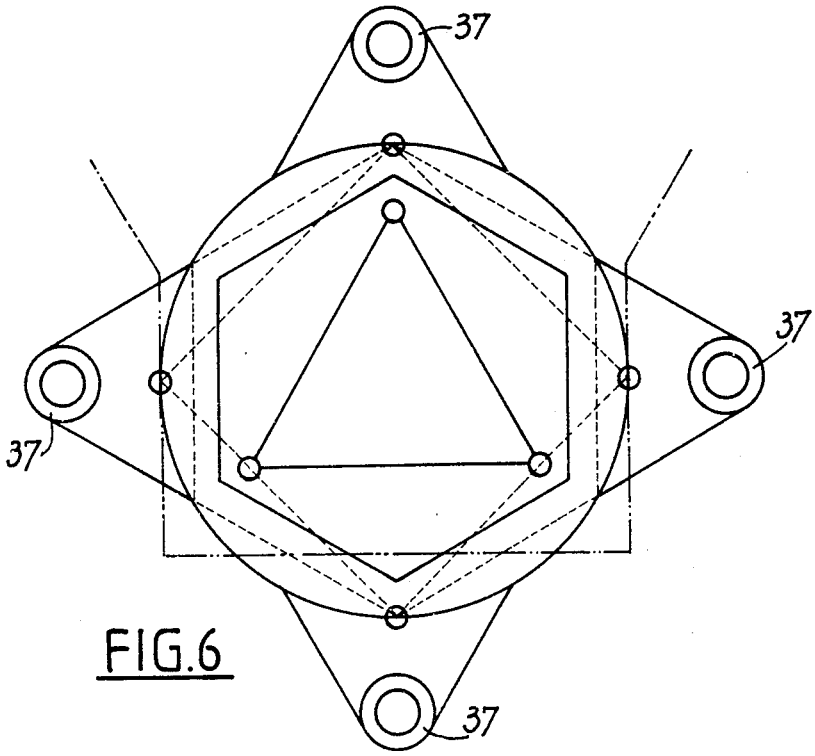
FIG.6

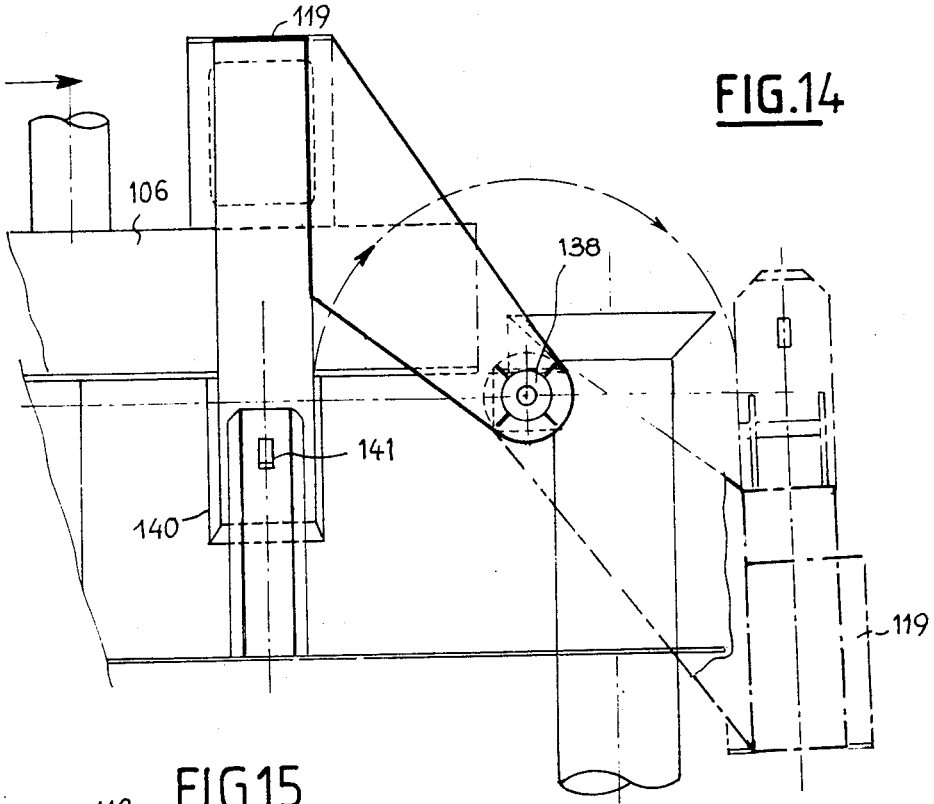
FIG.14
FIG.15
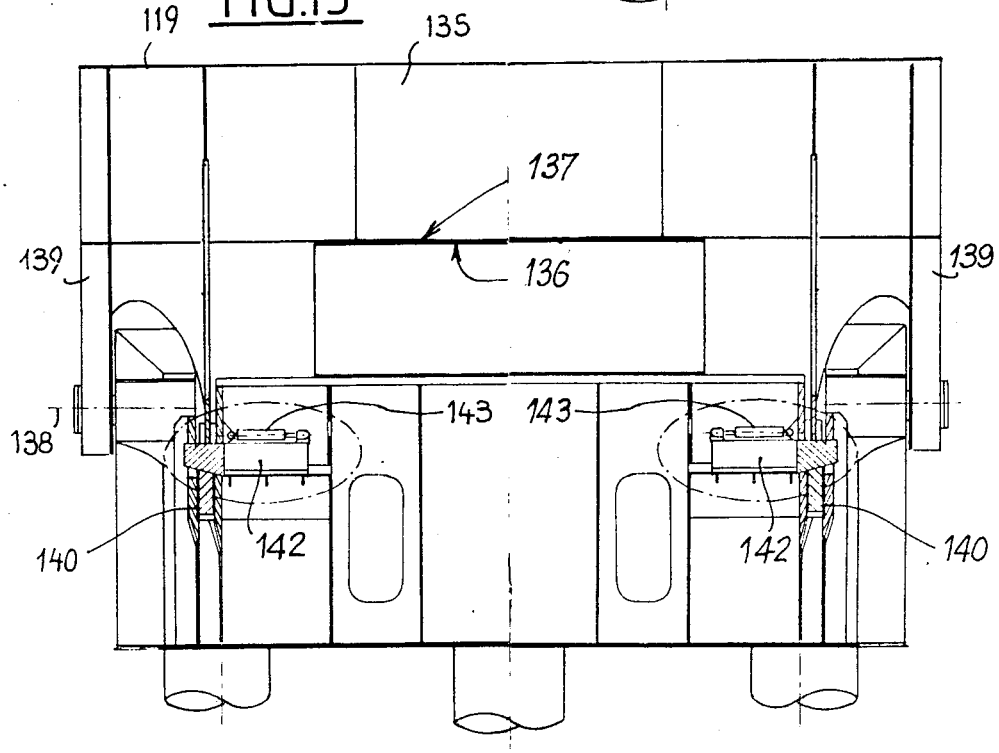

SUPPORT DEVICE FOR AN OFF-SHORE OIL DRILLING JACK-UP PLATFORM LEG AND PLATFORM INCLUDING SAID DEVICE

BACKGROUND OF THE INVENTION

1. Field of the Invention

The present invention relates to jack-up or self-jacking platforms for oil drilling and more particularly relates to platforms for oil drilling and/or oil production operations at sea.

2. Description of the Prior Art

Jack-up platforms for off-shore drillings have been used until recently for depths of less than 100 m.

The use of such platforms in difficult seas (North Sea, East Canada, etc.) for depths exceeding 100/110 m with 30 m high waves is rendered difficult:

by the dynamic behaviour of the platform resulting from the great extent of the support legs;

by the forces to which the platform is subjected on the part of the swell, the wind, the currents.

Some constructors propose designs which retain the conventional architecture of jack-up platforms for reaching depths exceeding 100/110 m. This results in a large increase in the dimensions of the legs and the hull and in the displacement when towing.

Legs of the lattice type are obtained with spacings between the members which may exceed 20 m.

The increase in the dimensions of the legs results in a large increase in the weight, a higher center of gravity when towing and therefore a loss of stability, and greater drag forces when towing.

Apart from the economic aspect, this renders the transfer of such a platform from one drilling site to another difficult.

Further, a jack-up platform does not permanently work at the maximum depth it is capable of reaching.

Consequently, a jack-up platform designed for a depth of 130 m will often be made to work at depths of 100 m and less and it is then faced with competition from smaller platforms which are easier to handle and cheaper to make.

Drilling operators prefer working with self-jacking platforms which are, in the high drilling position on their legs, "fixed" platforms, rather than with semi-submersible platforms which are mobile platforms.

Thus, at the present time, for depths of less than 80 m, jack-up platforms are almost exclusively employed.

Current constructions propose pushing back the limit of utilization of jack-up platforms to a depth of 100/110 m in difficult seas.

SUMMARY OF THE INVENTION

An object of the invention is to broaden the field of use of jack-up platforms to depths of 130/150 m and more for effecting development drillings.

The invention therefore provides a support device for a leg of an off-shore oil jack-up platform, said device comprising an individual, independent heightener adapted to be interposed between the leg of the platform and the sea bed so as to increase the depth of installation of the platform and improve the stability thereof, said heightener being provided with detachable, adjustable and lockable means for achieving a rigid fixing thereof to the lower end of the leg.

The invention also provides a self-jacking platform for off-shore drilling comprising a hull which is mounted to be movable and lockable in position along legs adapted to bear against the sea bed, wherein each leg is provided with a separable heightener of the type defined hereinbefore connected to the lower end of said leg and adapted to be interposed between the leg and the sea bed in the working position of the platform.

BRIEF DESCRIPTION OF THE DRAWINGS

A better understanding of the invention will be had from the following description which is given solely by way of example with reference to the accompanying drawings, in which:

FIG. 5 is a sectional view taken on line 5—5 of FIG. 4;

FIG. 6 is a partial plan view of a self-jacking platform provided with a heightener according to another embodiment of the invention;

FIG. 14 is a partial elevational view to an enlarged scale of means for securing a platform leg to its heightener;

FIG. 15 is a view in the direction of arrow G, with a part cut away, of FIG. 14;

DETAILED DESCRIPTION OF THE PREFERRED EMBODIMENTS

Figure 1:
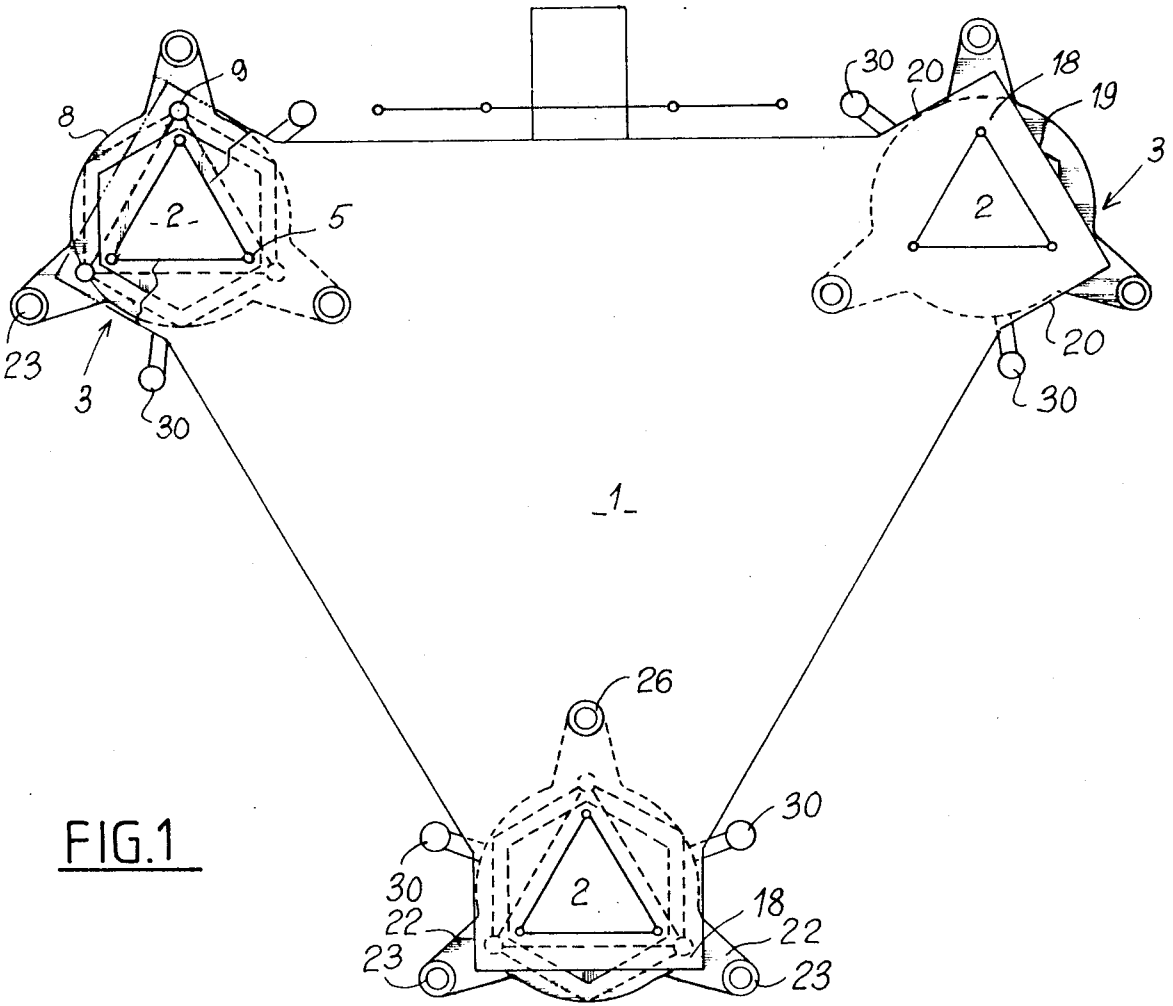
FIG. 1 is a diagrammatic plan view of a jack-up platform whose legs are provided with heighteners according to the invention.

The jack-up platform shown in FIG. 1 mainly comprises a hull 1 of generally triangular shape movably mounted on three vertical legs 2 adapted to bear against the sea bed when the platform is in its working position.

The platform is moreover equipped with a device for shifting the hull 1 with respect to the legs 2 and means for locking the hull with respect to the legs 2 (not shown).

The length of each of the legs of the platform is such as to normally permit the positioning of this platform on sites located at depths on the order of 100 to 110 m.

In order to increase the depth at which the platform may be operated, the platform is provided according to the invention with heighteners 3 which are separably connected to the lower ends of the legs 2.

As shown in more detail in FIGS. 1 to 4, each of the legs 2 has a triangular section and is formed by a lattice structure of metal girders. It terminates in its lower part in a foot 4 (FIG. 4) which, in the presently-described embodiment, has a hexagonal shape. Each of the feet 4 is constructed for example from welded sheet metal and fixed by welding to posts 5 of the corresponding leg. The upper and lower bearing surfaces 6 of each foot are advantageously arranged as a diamond point.

Figure 4:
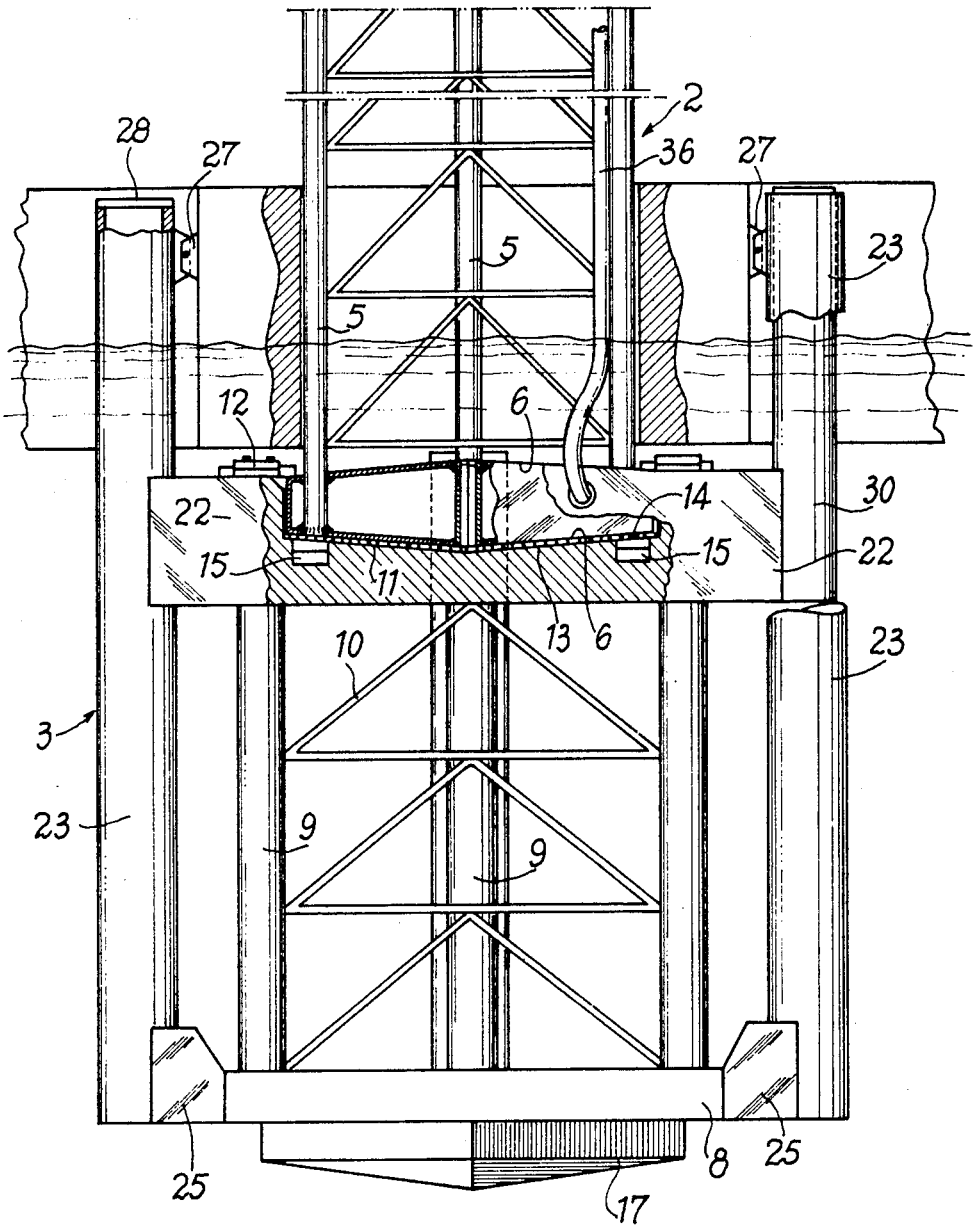
FIG. 4 is an elevational view, with a part cut away, of a heightener according to the invention provided on the self-jacking platform of FIGS. 1 to 3.

As shown in FIG. 4, one of the heighteners 3 is connected to the foot 4 of each leg 2 of the platform each heightener 3 comprising an upper plate 7 receiving the foot 4 and a lower plate 8 adapted to bear against the sea bed, the upper and lower plates being interconnected by tubular posts 9.

The tubular posts 9 are interconnected by a network or lattice of metal posts 10 forming with the girders the bearing structure of the heightener. The upper plate 7 of the heightener 3 is made from welded sheet metal and includes a cavity 11 whose shape corresponds to that of the foot 4 and in which this foot is engaged with clearance to permit the correction of the seating after the platform has been placed in position.

It is also possible to construct the supporting structure and the plates 7 and 8 in the form of concrete skirts and plates.

The heightener 3 is fixed to the leg 2 by locks 12 disposed on the periphery of the upper side of the plate 7.

The bottom 13 of the cavity 11 adapted to receive the foot 4 of the leg 2 is also in the shape of a diamond point.

Figure 2:
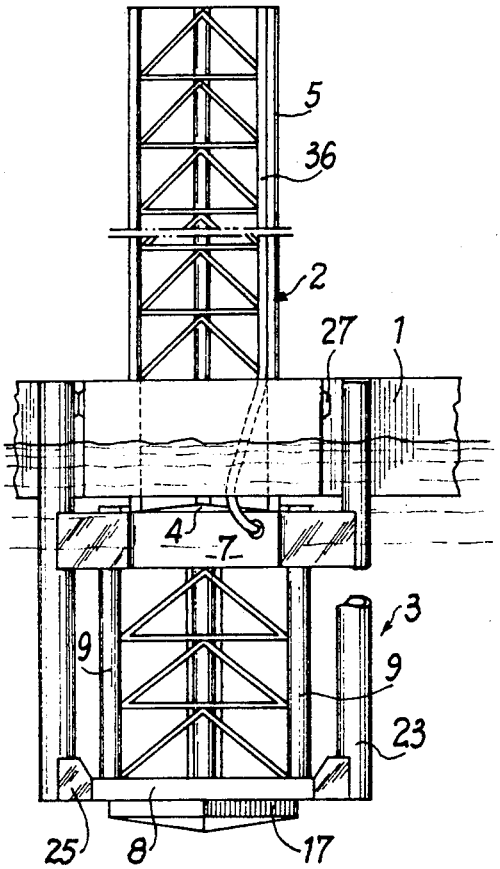
FIG. 2 is a partial elevational view of a leg of the self-jacking platform provided with a heightener according to the invention placed in the towing position.

In the towing position shown in FIGS. 2 and 4, and when the legs descend, the heightener 3 is maintained in suspension on the leg 2 by the locks 12. A slight clearance 14 is provided between the bearing surface 6 of the foot 4 and the bottom 13 of the cavity 11.

Disposed on the periphery of the bottom 13 are jacks 15 of a hydraulic device for correcting the seating which will be described in detail with reference to FIG. 7.

The lower plate 8 is also constructed from a welded sheet metal. It has a generally circular shape and includes on its lower side a shoe 17 in the shape of a diamond point adapted to penetrate into the ground.

As can be seen in FIG. 1, the legs of the platform are disposed in enlarged corner parts or end portions 18 of the hull 1 defined by end walls 19 which are respectively parallel to sides of the hull opposite thereto and by lateral walls 20 perpendicular to the walls 19 and each connected to one side of the hull 1. Each leg 2 is disposed in the respective end portion of the platform so that one of its sides is parallel to the respective end wall 19 of this portion.

Figure 3:
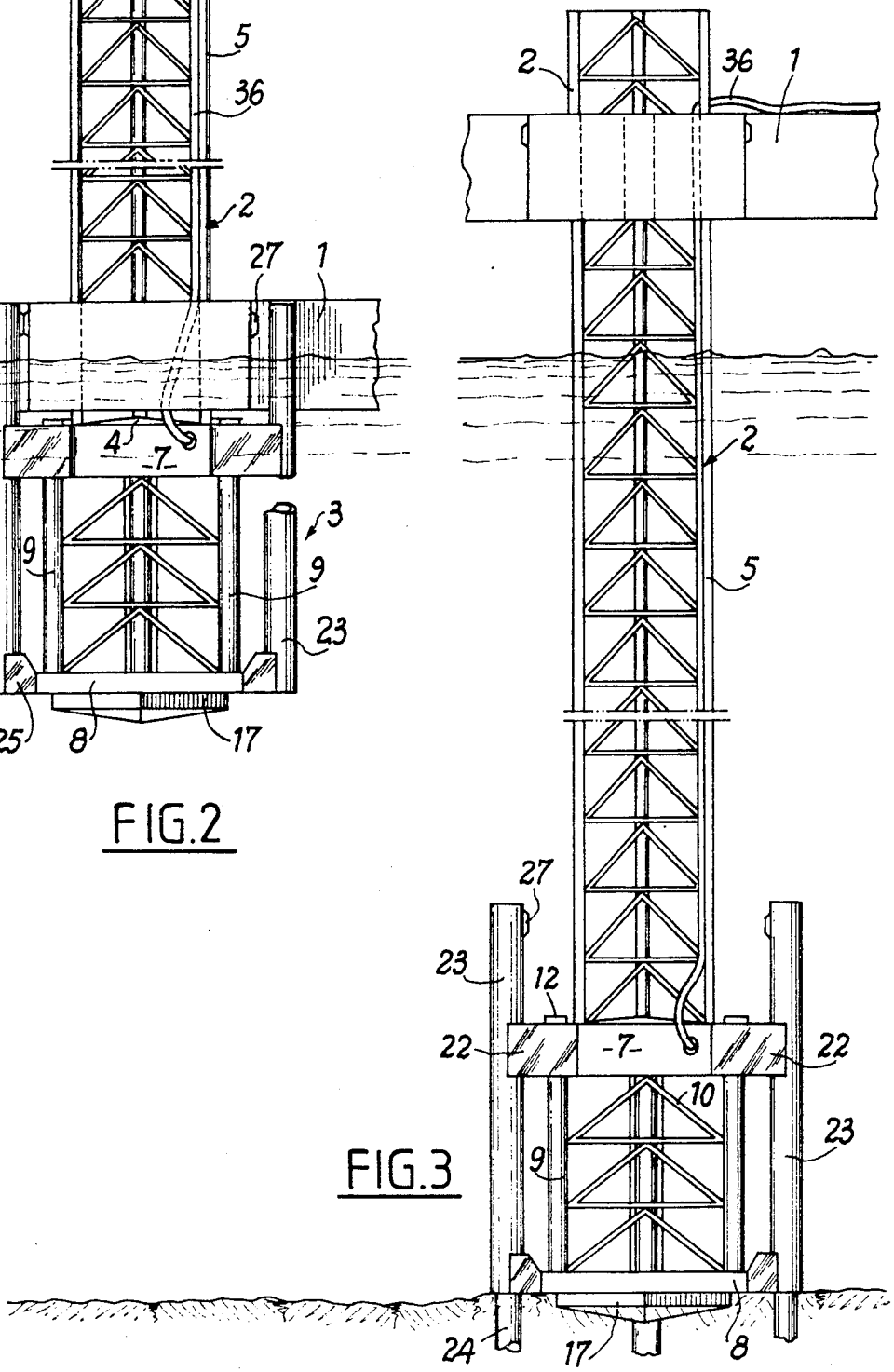
FIG. 3 is an elevational view of a leg of the self-jacking platform of FIG. 1 placed in the working position.

As can be seen in FIGS. 2 to 4, the heightener 3 has a framework whose section is similar to that of the corresponding leg 2 but of larger dimensions. The upper plate 7 of the heightener includes lugs 22 spaced 120° apart to which are welded tubular sleeves 23 adapted to receive piles 24 for piling the heightener into the ground. The sleeves 23 are also fixed by welding to lugs 25 of the lower plate 8 which are also spaced 120° apart.

As can be seen in FIGS. 1 and 5, the sleeves 23 are disposed relative to the platform in such manner that two of them are permanently located outside the overall size or periphery of the hull so as to permit the placing of the piles in position by means outside the platform.

The third sieve is disposed below the hull roughly in the region of the bisector of the angle thereof in which the corresponding leg is mounted and a passageway 26 is provided in the hull for gaining access to this sleeve.

As shown in FIG. 4, when the platform is in the towing position and the legs 2 are completely withdrawn above the hull 1, the sleeves 23 of the heighteners 3 are immobilized relative to the hull by a towing lock 27.

The sleeves 23 also act as floating stabilization devices and are provided for this purpose with closing devices 28 located at their upper ends.

The heightener is further provided with stabilization and immersion tubes 30 which are symmetrically disposed relative to the hull 1 and fixed to the upper plate 7 and lower plate 8 of the heightener.

Figure 7:
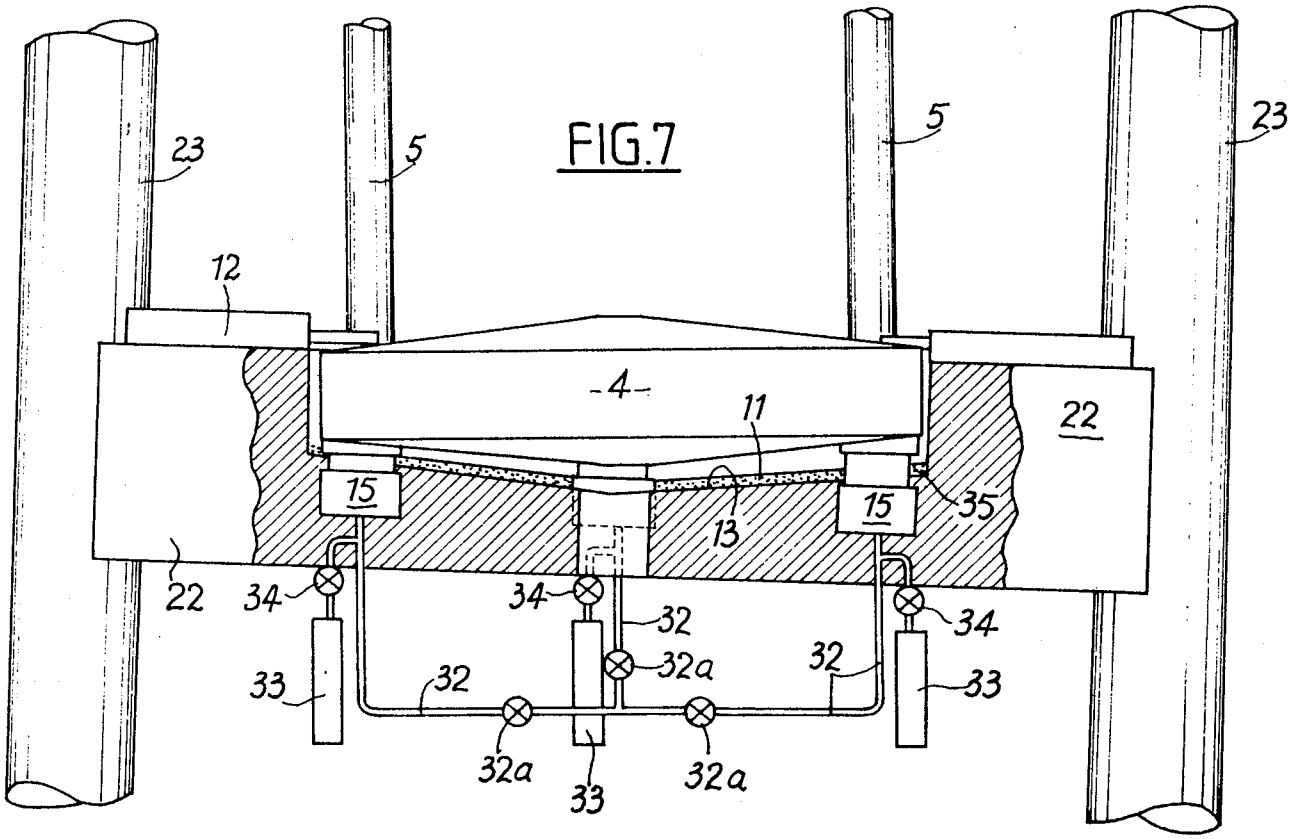
FIG. 7 is a partial sectional view, to, an enlarged scale, of the upper part of a heightener provided with means for correcting its seat.

As shown in FIG. 7, the jacks 15 interposed between the bottom 13 of the cavity 11 of the upper plate 7 of the heightener and the foot 4 of the leg 2, are interconnected by conduits 32 which put them into communication with one another through valves 32*a*. They are, moreover, each connected to a pressure accumulator 33 through a valve 34. Advantageously disposed between the foot 4 and the bottom 13 of the cavity 11 is a pad or layer 35 of a distribution material, which may be sand enclosed in a covering forming a sand box, or flexible products such as elastomers which adapt themselves to the shape of the foot 4.

The heighteners 3 are installed below the hull 1 of the platform in the floating position as shown in FIGS. 2 and 4. They are rendered stable in this stage by the closed sleeves 23 and the tubes 30 which emerge from the water.

Each heightener is disposed in such manner that the cavity 11 of its upper plate 7 receives the foot 4 of the corresponding leg 2.

The heightener 3 is immobilized relative to the leg 2 by the locks 12. Moreover, the heightener 3 is immobilized relative to the hull 1 of the platform by towing locks 27 which immobilize the tubular sleeves 23 relative to the lateral walls 20 of the corresponding end portion 18 of the hull 1. Similar towing locks are advantageously provided for immobilizing the tubes 30.

The unit is then ready to be towed to the exploitation site. The tubular sleeves 23 and the tubes 30 ensure the floating stabilization of the heightener.

When the platform reaches the exploitation site, the towing locks 27 are actuated so as to release the heightener 3 from the hull 1 and the legs 2 are shifted downwardly by shifting devices (not shown) carried by the hull 1.

The stabilization tubes 30 are also open at both ends to allow the entry of the water.

When the heightener comes into contact with the ground in the position shown in FIG. 3, the shoe 17 of the heightener penetrates into the ground, and the lugs 25 of the lower plate 8 increase the stability of the seating on the bottom by bearing against the ground. The shoes 17 have dimensions greater than those of the feet 4 of the legs 2 of the platform and therefore resist the greater forces due to the increase in depth.

The heightener is then anchored by driving into the ground the piles 24 which were previously placed in position in the tubular sleeves 23 either from the exterior of the platform in respect of the sleeves 23 located outside the corresponding end portion 18 of the hull or by engagement in the passageway 26 of the hull (FIG. 1) in respect of the tubular sleeve located below this hull and which for this reason has a length less than that of the two tubular sleeves outside the hull, as shown in FIG. 4.

The piles 24 are placed in position from the surface by means of the crane mounted on the hull 1 which handles the piles and the subsea hammers.

The piles are then fixed to the sleeves 23 by the injection of cement which is brought to the bottom through a flexible pipe (umbilical pipe) 36, the sleeves 23 being provided with annular sealing elements at each of their ends (not shown).

The pad 35 of distribution material at this moment ensures the distribution of the load of each leg 2 in the cavity 1 of the upper plate 7 of the heightener.

The seat distributing device shown in FIG. 7 operates in turn as a flexible swivel-joint or as a rigid insert.

Initially, the hydraulic circuit of the jacks 15 is filled with a liquid, the valves 32*a* are closed while the valves 34 remain open.

When the heightener 3 comes into contact with the sea bed, the jacks behave as a system which is rigid in rotation but vertically resilient owing to the presence of the accumulators 33.

If the heightener 3 placed on the bottom of the sea has a slight inclination relative to the vertical, the locks 12 maintaining the heightener in position relative to the corresponding leg 2 are partly opened. The leg 2 is then free to tilt slightly relative to the heightener owing to the clearances provided between the cavity 11 of the upper plate 7 of the heightener and the foot 4 of the leg.

The opening of the valves 32*a* re-establishes the pressures between the jacks 15 and consequently corrects the seat of the foot 4 which is put back into a horizontal position.

The excess pressures resulting from forces exerted by the leg on the heightener in contact with the bottom are absorbed by the pressure accumulators 33 which results in a slight subsidence of the device which provides an additional clearance under the locks 12 completing that obtained by the partial opening of the locks and allowing a relative rotation between the foot 4 and the heightener.

The correction of the seat having been effected, the valves 34 and the valves 32*a* are closed. The device again acts as an insert providing a rigid support.

It is then sufficient to lock the locks 12 which will take up the clearances and ensure the connection between the heightener 3 and the corresponding leg 2.

The pressure accumulator 33 may advantageously be formed by a battery of oleopneumatic accumulators while the valves 34 and 32*b* may be valves remote-controlled by means of the umbilical pipe 36.

The seat-correcting device just described may be actuated at the same time as the locks 12 which limit or prevent any movement between the heightener 3 and the leg 2, depending on whether the jacks 15 are, or are not, put in communication with one another.

When the correction of the seat described hereinbefore is finished, there is injected between the foot 4 of each leg 2 and the bottom 13 of the cavity 11 of the heightener 3 in which the foot 4 is engaged, a cement adapted to ensure the rigidity of the support of the foot 4 on the heightener 3. This cement is advantageously supplied to the bottom through the hose 36 which is also used for transmitting control signals required for the positioning operations.

The arrangement just described is adapted for the installation of a jack-up platform provided with heighteners according to the invention on relatively soft and unequal subsea grounds in which there are risks of erosion or undermining.

In the case of good grounds, and/or grounds in which the undermining risks are low, the device may remain in the mode of operation in which the foundation on the ground surface is provided directly and solely by the bearing of the shoes 17 against this surface.

In this case, the structure of the heighteners may be simplified so as not to include sleeves for piles but only the stabilization and immersion tubes.

Further, for sites having a very flat bottom, the seat correcting devices may also be omitted.

In the embodiment just described, three piles 24 are provided for piling the heightener to the ground.

A great number of piles may of course be envisaged.

In the embodiment shown in FIG. 6, the legs of the jack-up platform are provided with heighteners whose general construction is the same as that described with reference to FIGS. 1 to 5 except for the fact that each of these heighteners comprises four tubular sleeves 37 disposed 90° apart on the periphery of the heightener so that three of them are located outside the overall size or periphery of the platform.

These sleeves also act as stabilization and floating tubes so that it is unnecessary to provide special tubes for this purpose as is the case of heighteners having three sleeves shown in FIGS. 1 to 5.

The installation just described has relative to conventional installations the following advantages:

It employs a basic jack-up platform having an immersion capacity to depths on the order of 100 to 110 m.

The increase in the performances is ensured by the junction of the heightener installed on the site by the jack-up platform itself and rigidly or non-rigidly piled to the sea bed.

After the drilling operations have finished, the jack-up platform may be released from its support constituted by the heighteners on which the legs of the platform are immobilized so that it becomes again a conventional jack-up platform retaining the maneuvering possibilities. For this purpose, it is sufficient to disengage the locks 12 fixing the legs 2 to their heighteners 3.

This is an important advantage since such a platform may thus remain competitive with respect to conventional platforms intended for depths of 100 to 110 m.

Another important advantage of the invention resides in the fact that a jack-up platform which has been removed by disconnection of its legs from the heighteners on which they were initially installed, may be brought back to the site and re-installed on the heighteners for carrying out maintenance work on the wells.

The arrangement of the invention also permits putting economically into production small oil fields at depths which may reach 130 to 150 m and more, and effecting development drillings of oil fields without installation of fixed platform and thus avoiding the immobilization of drilling equipment for several years which is not used but requires maintenance.

It will be understood that the heighteners of the arrangement just described are adaptable to all types of platforms having legs of square, circular or other section and feet having a section other than hexagonal.

FIGS. 8 to 17 show another embodiment of the jack-up platform according to the invention which is placed in position on a drilling or exploitation site by the prior installation of heighteners on the sea bed and by placing in position and subsequently securing on said heighteners the legs of the platform which has been floated to the site.

Figure 8:
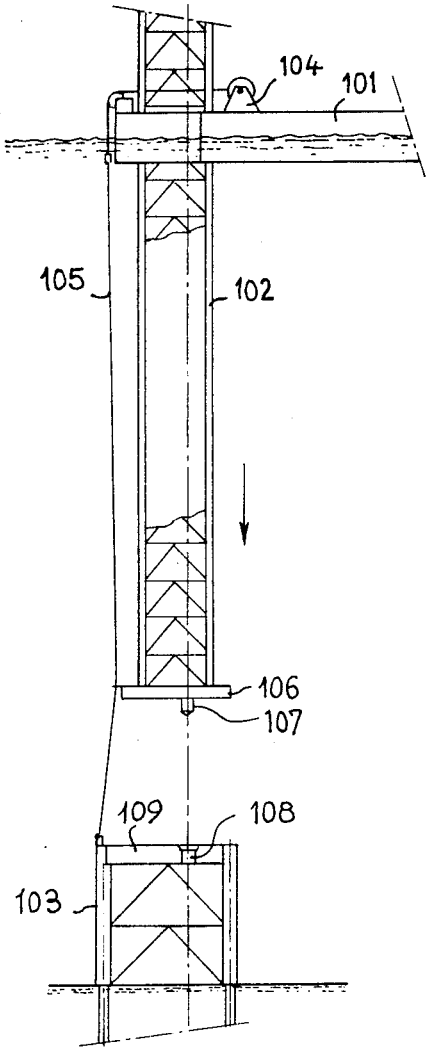
FIG. 8 is a partial diagrammatic view of a platform according to the invention in the course of installation on heighteners previously placed on a site.

FIG. 8 diagrammatically represents a jack-up platform comprising a hull 101 floating on the surface of the water and provided with legs 102 capable of being displaced relative to the hull by means of shifting devices (not shown) and capable of being immobilized with respect to the hull by locking means (not shown). The platform is brought above the location of the heighteners 103 fixed to the sea bed by means of winches 104 provided on the hull 101 which act on respective cables 105 whose ends are previously fixed to the corresponding heighteners 103. Each leg 102 is provided at its lower end with a foot 106 provided with a centering stud 107 adapted to be engaged into a corresponding opening 108 provided in an upper plate 109 of the heightener.

Figure 9:
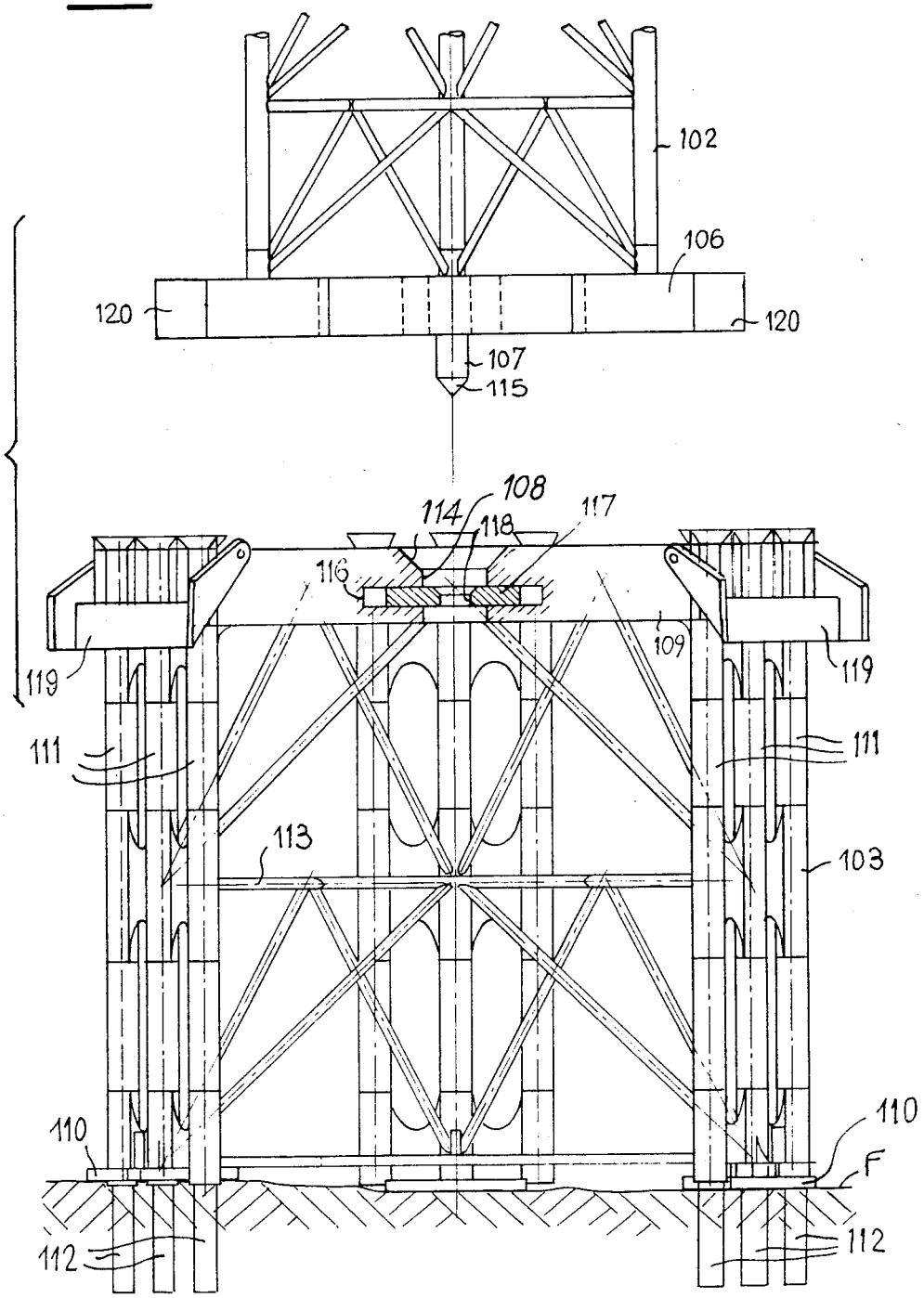
FIG. 9 is an elevational view with a part cut away of a heightener and a platform leg disposed above the latter before it is placed in position on the heightener.

FIG. 9 shows to an enlarged scale a heightener 103 placed in position on the sea bed F and, above the latter, the lower end of a leg 102 ready to be placed in position on the upper plate 109 of the heightener.

Figure 10:
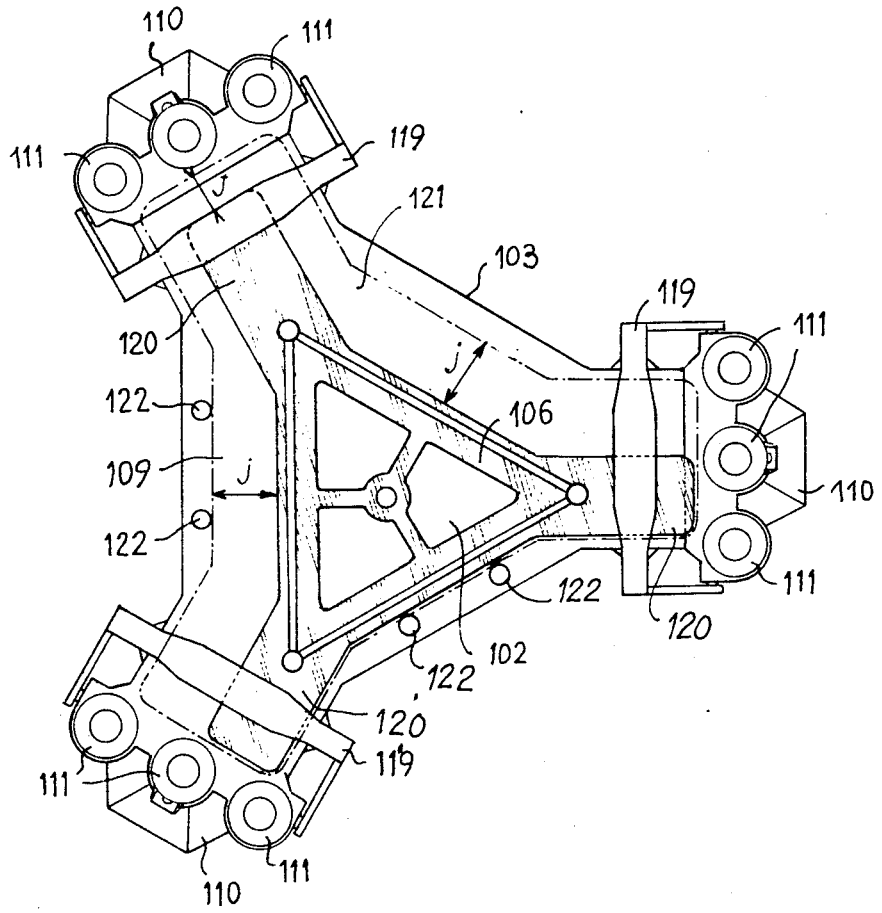
FIG. 10 is a top plan view partly in section of a platform leg fixed to its heightener.

As can be seen in FIG. 10, the heightener 103 has a generally triangular cross-sectional shape. It comprises the upper plate 109 and three sole or laying plates 110 each connected to the upper plate 109 by three tubular posts or sleeves 111 in which are engaged piles 112 for anchoring the heightener in the sea bed. The assembly thus arranged is reinforced by a metal lattice structure 113.

In two of the heighteners 103, the centering opening 108 provided in the plate 109 has a diameter greater than the diameter of the centering stud 107 of the foot 106 of the leg 102 so as to permit taking up possible inaccuracies in the laying of the heighteners.

The centering opening 108 has a conical entrance 114 for cooperating with a conical end 115 of the centering stud 107 of the leg 102 when it is engaged into the opening 108.

Also provided in the plate 109 is cavity 116 which communicates with the centering opening 108 and has a section greater than the latter. Engaged in the cavity 116 is a washer 117 for horizontally immobilizing the stud 107 relative to the heightener 103 and having at its center an aperture 118 having a tapered entrance and a diameter equal to the diameter of the centering stud 107.

Also provided on the upper plate 109 of the heightener are three pivotal locks 119 in the shape of yokes adapted to engage with lateral projections 120 of the foot 106 of the platform leg 102 and thus lock the leg to the heightener 103 against any vertical displacement.

As can be seen in FIG. 10, the leg 102 is disposed on the heightener 103 in a position which is laterally offset relative to its axis of symmetry owing to the relative inaccuracy of the laying of the heightener 103 on the sea bed. This is possible due to the possibility of a positioning adaptation afforded by the difference of diameter between the centering opening 108 of the upper plate 109 of the heightener and the centering stud 107 of the leg 102 represented in FIG. 9. It can be seen that, due to this difference in diameter, the foot 106 may occupy on the surface of the upper plate 109 of the heightener 103 a zone 121 represented in dot-dash lines and having an area larger than the overall size of the foot 106.

Thus, in the embodiment shown in FIG. 10, the foot 106 is placed against an edge of this zone 121 and is placed with clearances j relative to the other two edges of this zone.

The dimensions of the locking yokes 119 are also such as to enable each thereof to come into engagement with the corresponding lateral projection 120 of the platform foot 106, irrespective of the position the foot occupies on the positioning zone 121 of the heightener 103 defined by the contour in dot-dash lines.

It can also be seen in FIG. 10 that the heightener is provided on two of its sides with breasting pile dolphins 122 formed by vertical elastic tubular elements.

Figure 11:
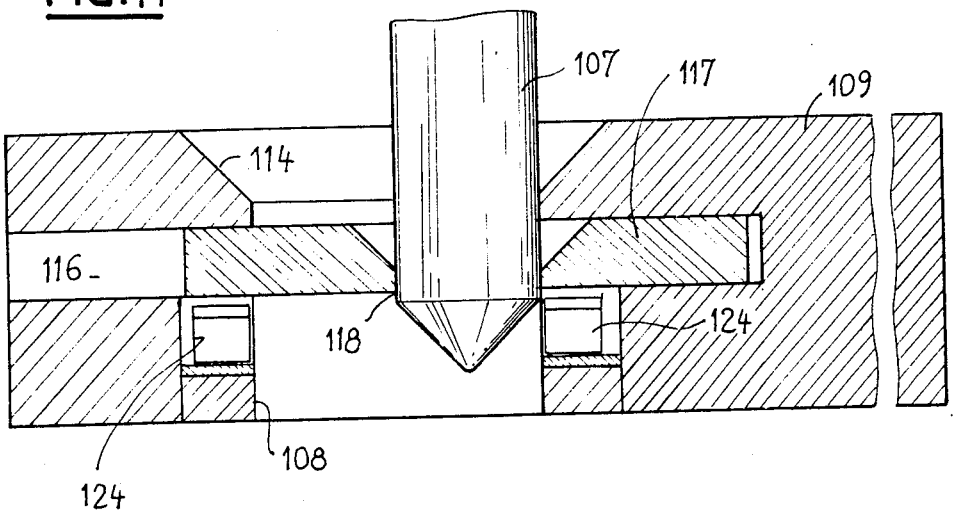
FIG. 11 is a partial sectional view to an enlarged scale of the means for centering two of the platform legs on their corresponding heighteners.
Figure 12:
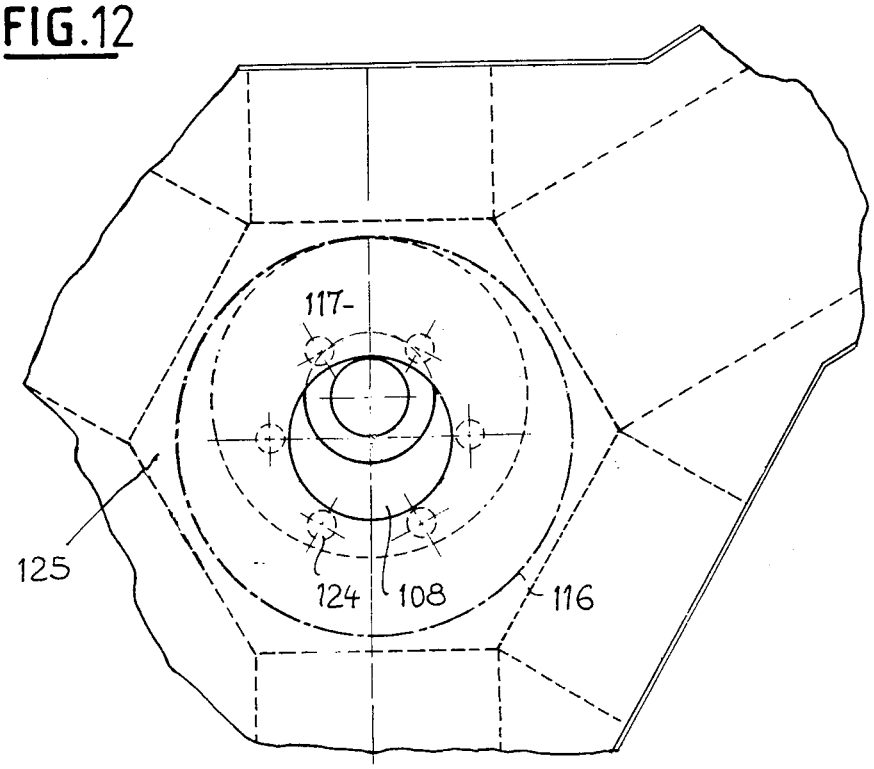
FIG. 12 is a top plan view to a reduced scale of the means shown in FIG. 11.

The means for centering a platform leg with respect to the heightener intended to support it are shown in more detail in FIGS. 11 and 12.

FIG. 11 shows the upper plate 109 provided with its centering opening 108 and tapered entrance 114 in which is provided the cavity 116 communicating with the centering opening 108. Disposed in the cavity 116 is the centering washer 117 whose central aperture 118 is occupied by the centering stud 107 of the corresponding platform leg. The centering stud 107 is placed against an edge of the centering opening 108 of the plate 109 and the centering washer 117, termed floating washer, is offset relative to the axis of the centering opening 108 and immobilized horizontally by clamping devices 124 mounted on the plate 109.

These clamping devices comprise jacks which will be described in detail with reference to FIG. 13.

As shown in FIG. 12, the floating washer 117 may occupy in its cavity 116 a zone 125 represented in dot-dash lines corresponding to all of the positions the centering stud 107 of the leg 102 may occupy in the centering opening 108 of the upper plate 109 of the heightener.

Figure 13:
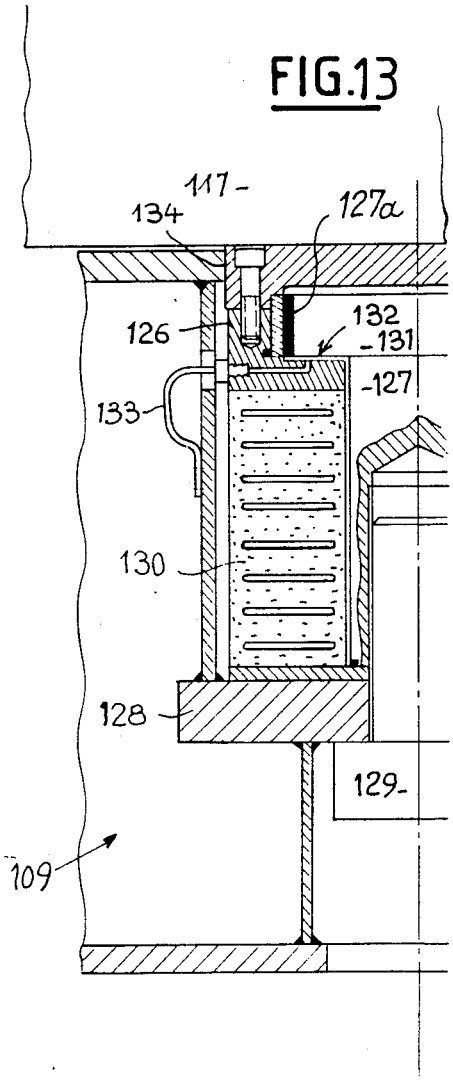
FIG. 13 is a sectional view to an enlarged scale of a jack which is part of the centering means shown in FIGS. 11 and 12.

One of the clamping jacks 124 of the floating washer 117 for clamping it against the plate 109 is shown in FIG. 13. It comprises a jack body 126 which is movable relative to a fixed rod 127 bearing against a support 128 fixed to the upper plate 109 by a fixing element such as a screw 129. The jack body 126 bears against a yieldable annular shoe 130 surrounding the fixed rod 127 between a head 131 of which and the body of the jack 126 there is provided a chamber 132 which is fed with hydraulic fluid through piping 133.

The force developed by putting the chamber 132 under pressure compresses the elastically yieldable annular shoe 130 so that the jack body 126 is retracted into its cavity 134 provided in the upper plate 109. The floating washer 117 which, in the absence of pressure applied to the chamber 132, is maintained clamped against the inner wall of the cavity 116 of the upper plate 109, is then released and can slide inside the cavity 116.

When the centering stud 107 of the platform leg engages into the central aperture 118 of the washer 117 and places itself in the appropriate position in the centering opening 108 of the plate 109, it is sufficient, for horizontally immobilizing the washer 117, and consequently the stud 107, to interrupt the pressurizing of the chamber 132 of each of the jacks. The jack body 126 is then firmly pressed against the washer under the action of the elastic return force exerted by the annular shoe 130. The washer 117 is immobilized in its cavity 116 all the better as the contacting surfaces of these two elements are rendered rough.

These shoes are advantageously formed by a stack of washers of elastomer and rigid washers which may be for example of metal and adhered together.

The seal between the movable jack body 126 and the fixed rod 127 of the jack may be advantageously achieved by means of sleeves 127*a* of elastomer bonded or adhered to the jack body 126 and to the rod 127, these sleeves being deformable under shear stress.

Figure 11A:
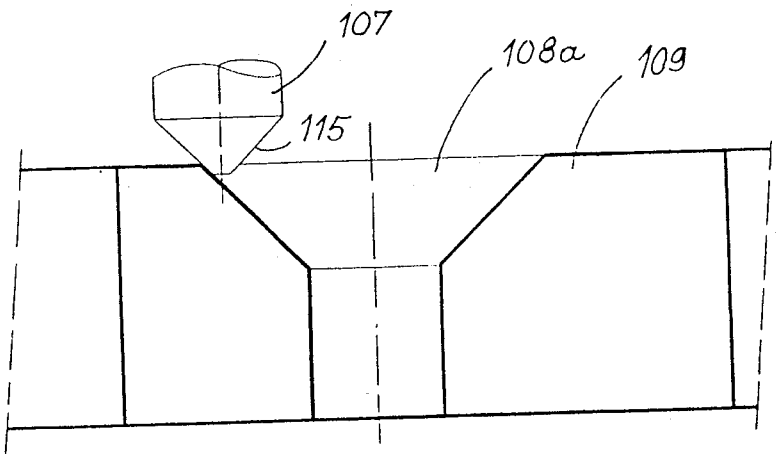
FIG. 11A is a partial sectional view of the centering means of the third leg.

The centering device of the type just described with reference to FIGS. 11 to 13 is provided on only two heighteners of a platform having three legs each of which is provided with a heightener. As shown in FIG. 11A, in the upper plate 109 of the third heightener, the centering opening 108*a* has an inside diameter equal to the outside diameter of the centering stud 107 of the corresponding leg so that this third heightener defines a platform positioning reference.

Thus, it is sufficient to place the platform in position on its heighteners, to engage first of all the centering stud 107 of the leg 102 in the reference heightener, this leg being then perfectly centered relative to its heightener owing to the identical diameters of the centering stud 107 and the central opening 108*a* of its plate 109, and to thereafter displace by any suitable means the whole of the platform around its leg 102 engaged in the reference heightener until the centering studs 107 of the other two platform legs are engaged in the centering openings 108 of larger diameter provided on the other two heighteners 103. As each of the latter is provided with a centering device of the type described with reference to FIGS. 8 to 13, it is then sufficient to actuate the clamping jacks of each of these devices to ensure the immobilization of the whole of the platform.

The vertical locking means of each platform leg on its heightener are shown in more detail in FIGS. 14 to 17.

As shown in FIG. 9, each heightener 103 is provided with three locks 119 in the shape of yokes pivotally mounted on its upper plate 109 and in a retracted position before the foot 106 of the corresponding leg 102 is placed on the plate 109.

In FIG. 14, the lock 119 is shown in full lines in its position for locking the foot 106 of the corresponding leg 102, and in dot-dash lines in its retracted position.

In the retracted position, the lock 119 completely clears the laying surface or zone 121 on the plate 109 (FIG. 10).

Each lock 119 has a cross-member 135 (FIG. 15) whose width is sufficient to overlap the corresponding projection or sole plate 120 of the foot 106 placed in haphazard manner on the laying surface or zone 121. The lower surfaces 136 of the cross-members 135, in the same way as upper surfaces 137 of the sole plates 120, are planar surfaces which come into contact with each other when the pivotable locks 119 are in their closed position. Each of these locks is pivotable about a pivot pin 138 and includes two arms 139 and two locking plates 140 each provided with an opening 141. A slidable latch 142 shifted by a jack 143 is mounted in the upper plate 109 of the heightener in the region of the openings 141 when the yoke 119 is in the closed or locking position.

Figure 16:
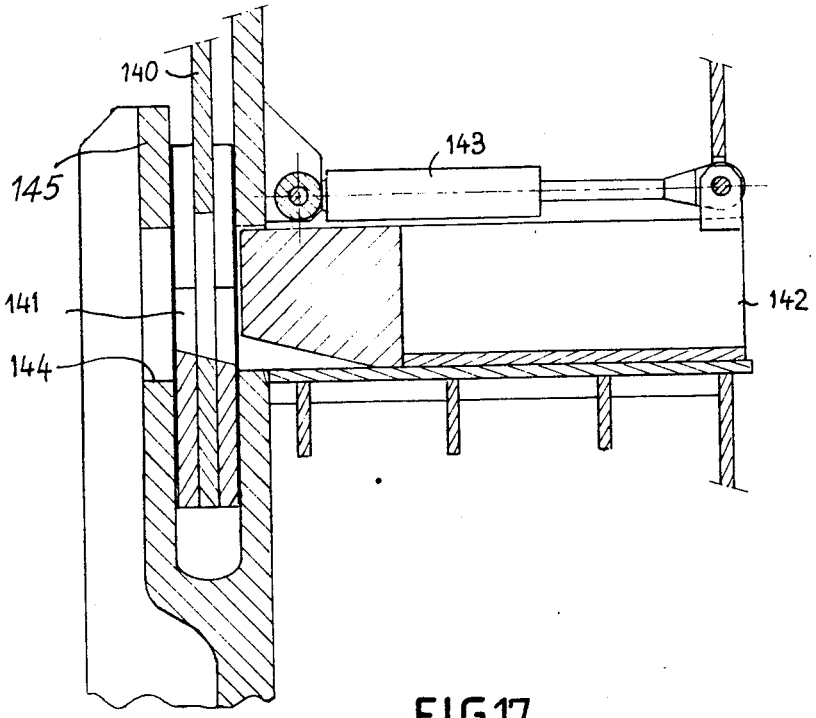
FIG. 16 is an elevational and sectional view of a latch which is part of the securing means of FIG. 14, shown in the disengaged position.

There is shown in FIG. 16 a latch 142 in the position disengaged from the opening 141 of the corresponding locking arm 140 of the yoke 119. The jack 143 is in its position of rest.

Figure 17:
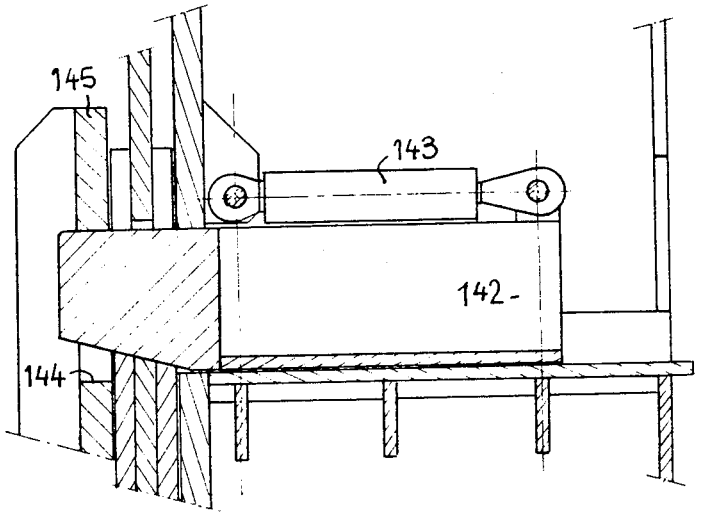
FIG. 17 is a view corresponding to FIG. 16 of the latch in the latching position.

FIG. 17 shows that the latch 142 has been engaged in the opening 141 of the corresponding locking arm 140 under the action of the jack 143 which is maintained in this active position. The locking is still further improved by the introduction of the end of the latch 142 into an opening 144 provided in a vertical wall 145 of the upper plate 109.

The arrangement of the jack-up platform just described permits a relatively easy positioning of the legs of the platform on heighteners previously placed on the exploitation site. The platform is brought to the site and the legs 103 are descended one after the other so that each of them comes to bear against one of the heighteners. For this purpose, there is first of all descended the leg intended to be placed on the heightener provided with a centering opening 108*a* whose diameter is equal to the diameter of the centering stud 107 of its foot 106.

This first leg 102 is positioned by means of winches 104 disposed on the platform. A first positioning of the leg 102 with respect to its heightener is facilitated by the engagement of the leg 102 into contact with the breasting pile dolphins 122 provided on two sides of the heightener 103.

When the first leg 102 is placed in position on its heightener 103, it determines a reference axis about which the whole of the platform can be turned until the other legs 102 of the platform are located in confronting relation to the corresponding heighteners 103. These legs are then lowered in such manner that their centering studs 107 enter the centering openings 108 which are of larger diameter and provided in the upper plates 109 of the other two heighteners and enter the central apertures 118 of the corresponding floating washers 117 by shifting them laterally toward the position in which they will be immobilized.

The horizontal immobilization of the floating washers 117 is then effected by actuating the jacks 124 which, as can be seen in FIG. 12, are disposed in a ring arrangement so as to exert on the washer 117 a homogeneous clamping force.

The yoke-shaped locks 119 are then actuated so that the cross-members 135 are applied against the lateral projections or sole plates 120 of each of the feet 106. The locks 119 are thus immobilized by the introduction of the latches 142 in their respective openings, 141. The platform is then horizontally immobilized by the floating washers 117 clamped by their jacks 124 and vertically immobilized by the locks 119 and can withstand the horizontal forces and the vertical forces and the moments to which they are subjected.

If it is desired to remove the platform from the site in which it is placed, it is sufficient to disconnect the legs 102 of the platform from their heighteners 103 by releasing the locking means 119.

It will be understood that it is also possible to return to the site and to then repeat the operations for placing the platform in position in the manner described hereinbefore.

In the embodiment described with reference to FIGS. 9 to 17, one of the heighteners has a centering opening 108*a* of the same section as the centering stud 107 of the corresponding platform leg. However, it may be envisaged to provide all the heighteners with centering openings 108 whose section is larger than that of the centering studs 107.

In this case, all the heighteners include a centering washer 117 and immobilizing means for the latter.

When the platform must remain a long time on the site, it is also possible to employ instead of the floating washers 117 and the jacks for immobilizing the latter, sealings of concrete or resin for immobilizing the centering studs 107 in the centering openings 108 of larger diameter.

What is claimed is:

1. A support device for one of the several independent legs of an off-shore oil jack-up platform having a hull movably mounted on the legs, each of which is adapted to bear against the seabed when the platform is in a working position, said device comprising an individual, independent heightener adapted to be interposed between a respective leg of the platform and the sea bed so as to increase the depth of installation of the platform and improve the stability thereof, said heightener being provided with detachable, adjustable and lockable means for rigidly fixing the heightener to the lower end of the respective leg.

2. A support device according to claim 1, wherein said heightener comprises an upper plate for connecting the heightener to the respective leg of the platform, a lower plate by which the heightener bears on the sea bed, and a bearing structure interconnecting said upper plate and said lower plate.

3. A support device according to claim 1, wherein the respective leg has a foot on said lower end thereof and the upper plate comprises a cavity for receiving the foot and locks for immobilizing the foot in said cavity.

4. A support device according to claim 3, wherein the cavity has a bottom and the foot has a bearing surface whose shape substantially corresponds to the shape of said bottom of the cavity.

5. A support device according to claim 3, wherein the cavity has a bottom which is provided with a layer of a material for distributing forces exerted by the foot on the heightener.

6. A support device according to claim 5, wherein said layer of material comprises sand enclosed in a covering which adapts itself to the shape of the foot.

7. A support device according to claim 5, wherein said layer of material is a flexible product which adapts itself to the shape of the foot.

8. A support device according to claim 2, wherein the lower plate comprises a shoe adapted to penetrate into the ground.

9. A support device according to claim 2, wherein the bearing structure of the heightener comprises tubular posts interconnecting the upper plate and the lower plate, and a lattice of metal girders interconnecting said posts.

10. A support device according to claim 2, wherein the heightener is provided with tubular sleeves for placing in position piles for anchoring in the ground, said sleeves acting as stabilization means when towing the heightener mounted on the respective leg of the platform and being provided for this purpose with respective detachable closing devices at at least one end of said sleeves.

11. A support device according to claim 10, wherein said upper plate and lower plate have radially outwardly extending lugs and said tubular sleeves are fixed to the radial lugs, said lugs being angularly spaced apart on a periphery of said plates, the length of said lugs being such that a plurality of the tubular sleeves are located outwardly of the outer periphery of a hull of the platform receiving the device and one of the sleeves is adapted to be located under the hull.

12. A support device according to claim 11, wherein said tubular sleeves are three in number and are spaced 120° apart on a periphery of the heightener.

13. A support device according to claim 3, further comprising floating stabilization tubes fixed to the heightener and adapted to place the heightener under the corresponding foot by a controlled immersion of the heightener.

14. A support device according to claim 11, wherein said tubular sleeves are four in number and are spaced 90° apart on a periphery of the heightener.

15. A support device according to claim 2, further comprising a device for correcting a seating between said heightener and the respective leg of the platform on which it is mounted.

16. A support device according to claim 15, wherein the corresponding leg has a foot on said lower end and the upper plate includes a cavity for receiving the foot, and the device for correcting the seating comprises hydraulic jacks disposed on a periphery of the bottom of said cavity, conduits and valves interconnecting the jacks and pressure accumulators connected to the jacks through valves.

17. A support device according to claim 2, wherein the upper plate and the lower plate and the bearing structure of the heightener are constituted by concrete plates and skirts.

18. A jack-up platform for off-shore oil drilling, comprising a hull, legs adapted to bear against the sea bed, the hull being mounted to movable along and lockable to the legs, each leg being provided with a separable heightener mounted on a lower end of said leg and adapted to be interposed between the lower end of the leg and the sea bed in the working position of the platform, said heightener being provided with detachable, adjustable and lockable means for rigidly fixing the heightener to the lower end of the leg.

19. A platform according to claim 18, wherein the heightener include towing lock means for attachment thereof to the hull whereby the heighteners are fixed to the legs and the hull in a towing position of the platform, the platform being used for placing the heightener on the working site.

20. A platform according to claim 18, wherein said heightener comprises an upper plate for connecting the heightener to the respective leg of the platform, a lower plate by which the heightener bears on the seabed, and a bearing structure interconnecting said upper plate and said lower plate, the heightener being further provided with tubular sleeves for placing in position piles for anchoring in the ground, said sleeves acting as stabilization means when towing the heightener mounted on the respective leg of the platform and being provided for this purpose with respective detachable closing devices at at least one end of said sleeves, the platform further comprising towing locks for fixing the heightener to the hull by at least some of the tubular sleeves thereof which extend outwardly of the outer periphery of the hull, so as to connect the heighteners to the hull during towing operations.

21. A support device according to claim 1, wherein said heightener is adapted to be previously fixed to the sea bed and said means for rigidly fixing the heightener to the lower end of the respective leg comprise means for centering the respective leg of the platform on the heightener and means for vertically locking the respective leg to the heightener.

22. A support device according to claim 21, comprising a centering stud fixed to the lower end of the respective leg, said heightener comprising an upper plate in which is provided a centering opening for receiving the centering stud provided on the lower end of the respective leg.

23. A support device according to claim 22, wherein the centering opening provided in the upper plate of the heightener has a section which is larger than the section of the centering stud carried by the respective leg and said centering means further comprise a cavity in said upper plate communicating with said centering opening, a centering washer horizontally movably mounted in said cavity, said washer defining a central aperture for receiving said centering stud, said aperture having a section which is equal to the section of said centering stud, said centering means further comprising means for immobilizing the centering washer in said cavity.

24. A support device according to claim 23, wherein the heightener comprises on its upper plate a leg-laying zone whose area is larger than the overall size of the lower end of the respective leg corresponding to the degree of freedom of horizontal movement of the respective leg relative to the heightener due to the difference in the section of the centering opening and the section of the centering stud.

25. A support device according to claim 24, wherein the means for immobilizing the centering washer in said cavity therefor comprise clamping jacks mounted in the upper plate and arranged around said centering opening in the upper plate.

26. A support device according to claim 25, wherein each of said clamping jacks comprises a movable jack body engaged in a cavity in the upper plate, a central rod fixed to the upper plate, said jack body and rod defining therebetween a chamber, means for feeding fluid under pressure to the chamber, and an elastically yieldable annular pad for returning the jack body to a clamping position thereof when said chamber ceases to be supplied with fluid under pressure, said pad cooperating with the jack body and surrounding said rod.

27. A support device according to claim 22, wherein the centering opening of said upper plate of the heightener has a section which is equal to the section of the centering stud of the leg.

28. A support device according to claim 22, wherein the respective leg terminates at the end thereof adapted to come into contact with the heightener in a foot which carries said centering stud, and said means for vertically locking the leg to the heightener comprise locks pivotally mounted on the upper plate of the heightener and cooperative with lateral projections of said foot for locking the foot to the heightener.

29. A support device according to claim 28, wherein said locks are in the shape of yokes, locking plates defining openings are connected to the locks and latches are provided for immobilizing the locks in a locking position of said locks by engagement of the latches in said openings provided in said locking plates, jacks being combined with said latches for placing said latches in locking positions in said openings in said plates connected to said locks.

30. A support device according to claim 22, wherein said heightener further comprises laying plates each connected to the upper plate by tubular posts adapted to receive piles for anchoring the heightener in the sea bed, the assembly thus formed being reinforced by a metal lattice structure.

31. A support device according to claim 21, wherein said heightener is provided with breasting pile dolphins on two sides thereof.

32. A jack-up platform comprising legs for bearing against a sea bed and a hull mounted to be movable and lockable in position along said legs; at least some of the legs being detachably and rigidly fixed to first support devices which are previously anchored in the sea bed, each first support device comprising a heightener provided with detachable, adjustable and lockable means for rigidly fixing the heightener to a lower end of the respective leg, said fixing means further comprising means for centering the lower end of the respective leg on the heightener and means for vertically locking the respective leg to the heightener.

33. A platform according to claim 32, wherein one of said legs is fixed to a second support device which has an upper plate defining a centering opening and the one leg has an end carrying a centering stud adapted to be inserted in said centering opening when placing the one leg on said heightener which thus constitutes a reference support, the other legs of the platform being capable of being placed in position by displacement of the whole of the platform about said reference support.

* * * * *